US011660867B2

(12) United States Patent
Takagi et al.

(10) Patent No.: US 11,660,867 B2
(45) Date of Patent: May 30, 2023

(54) LIQUID EJECTION HEAD

(71) Applicant: CANON KABUSHIKI KAISHA, Tokyo (JP)

(72) Inventors: Yosuke Takagi, Kanagawa (JP); Hiroki Tajima, Kanagawa (JP); Kyosuke Toda, Kanagawa (JP); Naoko Shimizu, Kanagawa (JP); Shimpei Yoshikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 17/112,490

(22) Filed: Dec. 4, 2020

(65) Prior Publication Data

US 2021/0170748 A1 Jun. 10, 2021

(30) Foreign Application Priority Data

Dec. 5, 2019 (JP) ..... JP2019-220471

(51) Int. Cl.
*B41J 2/14* (2006.01)
*B41J 2/175* (2006.01)

(52) U.S. Cl.
CPC ..... *B41J 2/1433* (2013.01); *B41J 2/17523* (2013.01)

(58) Field of Classification Search
CPC .... B41J 2/1433; B41J 2/17523; B41J 2/1752; B41J 2/1753; B41J 2/17553; B41J 2/17513; B41J 2/17506; B41J 2/1755
USPC ..... 347/47
See application file for complete search history.

(56) References Cited

U.S. PATENT DOCUMENTS

| | | | |
|---|---|---|---|
| 6,910,759 | B2 | 6/2005 | Kawamura et al. |
| 7,934,795 | B2 | 5/2011 | Ikegame et al. |
| 9,475,288 | B2 | 10/2016 | Kudo et al. |
| 10,040,290 | B2 | 8/2018 | Okushima et al. |
| 10,081,185 | B2 | 9/2018 | Kimura et al. |
| 10,391,767 | B2 | 8/2019 | Osaki et al. |

(Continued)

FOREIGN PATENT DOCUMENTS

| | | | |
|---|---|---|---|
| CN | 1344618 | A | 4/2002 |
| CN | 101491972 | A | 7/2009 |

(Continued)

OTHER PUBLICATIONS

Office Acton dated Jul. 12, 2022, in Chinese Patent Application No. 202011400652.6.

*Primary Examiner* — Matthew Luu
*Assistant Examiner* — Alexander D Shenderov
(74) *Attorney, Agent, or Firm* — Venable LLP

(57) ABSTRACT

A liquid ejection head includes a flow path-forming part having a flow path for liquid supplied from a liquid reservoir and a plurality of outlet ports for discharging the liquid, a liquid ejecting unit having a plurality of inlet ports into which the liquid flows and a plurality of ejection element rows corresponding to the inlet ports and each having a plurality of ejection elements to eject the liquid, and a sealing member having a sealing opening which allows communication between the plurality of outlet ports and the plurality of inlet ports. sealing member seals a portion between the flow path-forming part and the liquid ejecting unit so that the plurality of outlet ports and the plurality of inlet ports are in communication. A plurality of the sealing openings are provided for the sealing member, and at least one of the sealing openings has at least two inlet ports.

12 Claims, 20 Drawing Sheets

(56) References Cited

U.S. PATENT DOCUMENTS

| | | | | |
|---|---|---|---|---|
| 10,618,284 | B2 | 4/2020 | Kondo | |
| 2008/0111868 | A1 | 5/2008 | Yamane | |
| 2017/0232737 | A1* | 8/2017 | Komamiya | B41J 2/14153 347/17 |
| 2018/0257373 | A1 | 9/2018 | Toda et al. | |

FOREIGN PATENT DOCUMENTS

| | | | |
|---|---|---|---|
| CN | 106956513 | A | 7/2017 |
| CN | 109203715 | A | 1/2019 |
| CN | 109866506 | A | 6/2019 |
| JP | 2006-263996 | A | 10/2006 |
| JP | 2015-226988 | A | 12/2015 |

* cited by examiner

CROSS-SECTIONAL VIEW ALONG b-b

CROSS-SECTIONAL VIEW ALONG c-c

CROSS-SECTIONAL VIEW ALONG B-B

CROSS-SECTIONAL VIEW ALONG D-D

CROSS-SECTIONAL VIEW ALONG E-E

CROSS-SECTIONAL VIEW ALONG F-F

CROSS-SECTIONAL VIEW ALONG G-G

CROSS-SECTIONAL VIEW ALONG H-H

CROSS-SECTIONAL VIEW ALONG I-I

CROSS-SECTIONAL VIEW ALONG J-J

LIQUID EJECTION HEAD

BACKGROUND OF THE INVENTION

Field of the Invention

The present disclosure relates to a liquid ejection head for recording images by ejecting liquid such as ink on a recording medium.

Description of the Related Art

Various conventional recording methods using a liquid ejection head as means for recording images on a recording medium such as paper have been proposed, and examples of commercially available methods include thermal transfer, wire-dot, thermal, and ink-jet methods.

According to the ink jet method, ink is supplied to a liquid ejection head for forming images in various configurations. In one of the configurations, an ink tank having an ink storage chamber provided discretely from the liquid ejection head is connected to the liquid ejection head. In this way, ink in the ink tank is supplied to the liquid ejection head. In another available configuration, ink in an ink tank set in an image recording device such as a printer is supplied to a liquid ejection head through a liquid supply tube.

Ink is guided to a support member, on which a print element substrate is mounted, through an ink flow path formed in the case for the liquid ejection head. In the ink flow path, a sealing member of a rubber material is provided between the case and the support member to secure sealability for the ink flow path and prevent ink and air from leaking to the outside.

The print element substrate may be provided with a plurality of ejecting element rows for individually ejecting ink of different colors (such as cyan (C), magenta (M), and yellow (Y)). The case has an ink outlet port for discharging the ink from the ink flow path. The print element substrate has an ink inlet port into which the ink flowing out of the ink outlet port of the case flows. It is suggested to individually seal the periphery of the part where the ink outlet port and the ink inlet port communicate with each other by the sealing member (Japanese Patent Application Publication No. 2015-226988).

SUMMARY OF THE INVENTION

According to the disclosure of Japanese Patent Application Publication No. 2015-226988, when ejection element rows are arranged at least at prescribed intervals, an ink outlet port and an ink inlet port may be provided for each of the ejection element rows, and the periphery of the part where the ink outlet port and the ink inlet part are in communication may be individually sealed. However, when the spacing between the ejection element rows is reduced as the size of the print element substrate is reduced, the sealing openings of sealing members may interfere with one another, which makes it difficult to secure sufficient sealing openings, and desired sealing performance may not be provided. As a result, air and ink may be leaked from the ink flow paths.

Meanwhile, when an ink inlet port is provided in a position which allows a sufficient sealing opening for desired sealing performance to be obtained, the degree of flexibility in arranging ink inlet ports may be lowered. The ink inlet ports must be arranged in an optimum position in order to provide high bubble removability in the ink flow paths, and it is therefore undesirable that the arrangement of the ink inlet ports is limited because of the constraint related to sealing performance for the ink inlet ports.

With the foregoing in view, the present disclosure provides a liquid ejection head which allows a sealing opening to be secured for a sealing part when the spacing between the liquid discharge rows is reduced.

A liquid ejection head according to the present disclosure includes a flow path-forming part having a flow path for liquid supplied from a liquid reservoir and a plurality of outlet ports for discharging the liquid, a liquid ejecting unit having a plurality of inlet ports into which the liquid discharged from the plurality of outlet ports flows and a plurality of ejection element rows corresponding to the inlet ports and each having a plurality of ejection elements arranged in a row to eject the liquid, and a sealing member having a sealing opening which communicates the plurality of outlet ports and the plurality of inlet ports, the sealing member seals a portion between the flow path-forming part and the liquid ejecting unit so that the plurality of outlet ports and the plurality of inlet ports are in communication, wherein a plurality of the sealing openings are provided for the sealing member, and at least one of the plurality of sealing openings has at least two inlet ports among the plurality of inlet ports.

Further features of the present invention will become apparent from the following description of exemplary embodiments with reference to the attached drawings.

DESCRIPTION OF THE EMBODIMENTS

Preferred embodiments of the present disclosure will be described in conjunction with the accompanying drawings. Note however that the sizes, materials, and shapes of components and the positional relation thereof in the following description should be changed as appropriate depending on the configuration of the device to which the invention is applied and various other conditions. Therefore, the following description is not intended to limit the scope of the invention. As for features and steps which are not specifically shown or described, well-known features or known features in the art can be applied. The same description may not be repeated.

First Embodiment

Figure 1A:
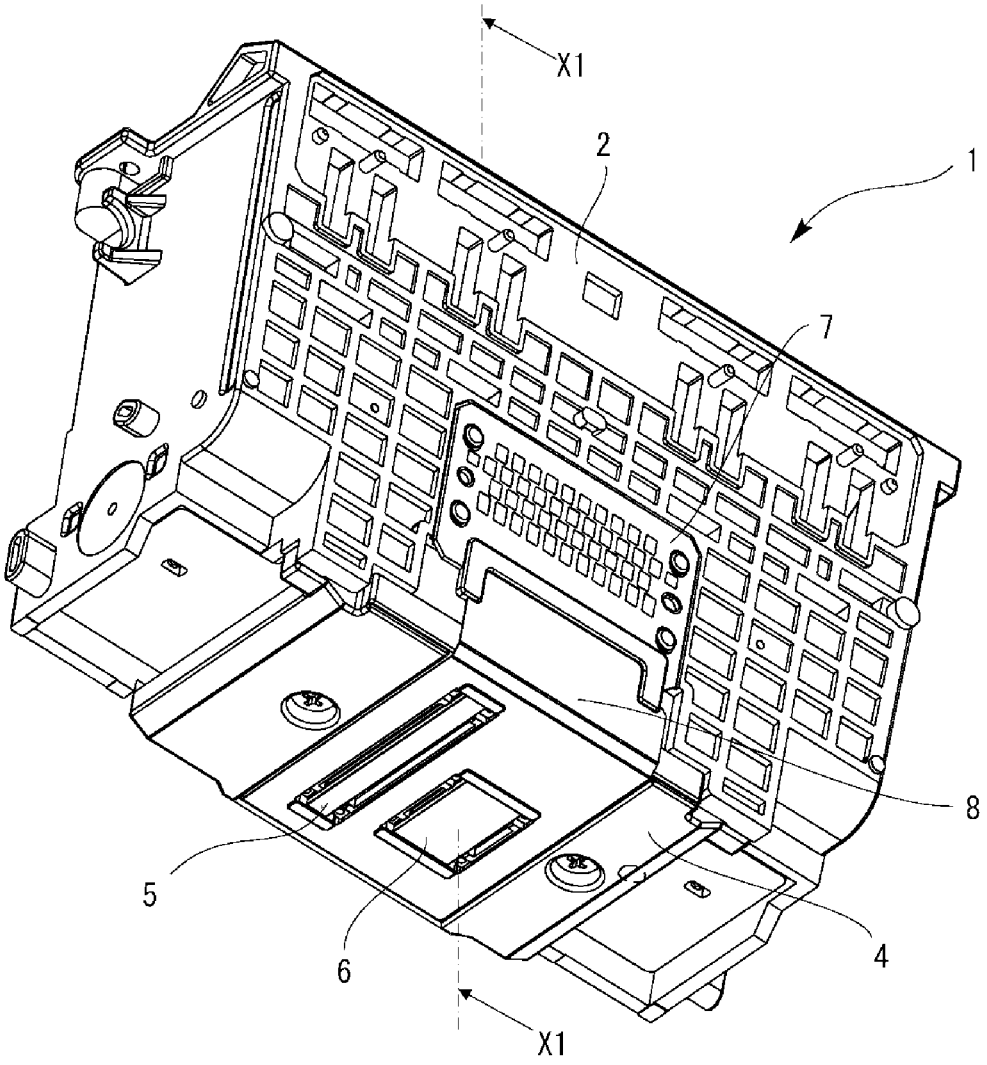
FIG. 1A is a perspective view of a liquid ejection head according to a first embodiment of the present disclosure.
Figure 1B:
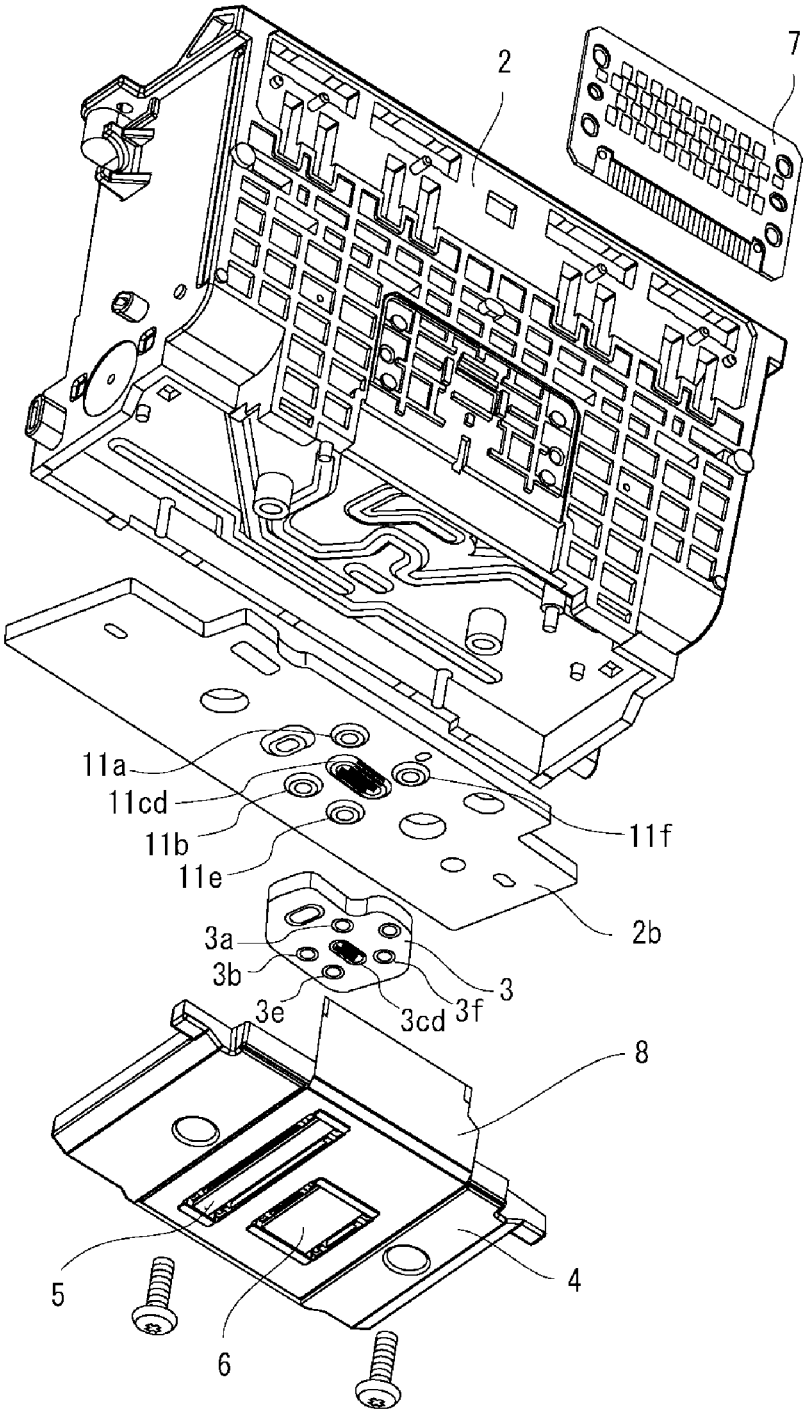
FIG. 1B is an exploded perspective view of the liquid ejection head according to the first embodiment.

A liquid ejection head according to a first embodiment of the present disclosure will be described. In the following description, it is assumed that the liquid ejection head is a so-called permanent type liquid ejection head which is discrete from an ink tank. The liquid ejection head in the following description may be a so-called disposable type (cartridge type) liquid ejection head which is integrated with an ink tank. FIGS. 1A and 1B show a liquid ejection head 1 for use in an image recording apparatus according to the first embodiment. FIG. 1A is a perspective view of the liquid ejection head 1, and FIG. 1B is an exploded perspective view of the liquid ejection head 1.

The liquid ejection head 1 according to the first embodiment has print element substrates 5 and 6 having the function of ejecting liquid such as ink and is mounted on a carriage (not shown) in the image recording apparatus to form an image by ejecting the liquid on a recording medium during scanning. Note that instead of being mounted on the carriage, the liquid ejection head 1 may be a so-called full-line type liquid ejection head in which the print element substrate is provided for the printing width.

The ink, which is liquid ejected for forming images, is stored in an ink tank 30 (see FIG. 2) as a liquid reservoir. The ink is supplied to the liquid ejection head 1 when the ink tank is mounted to the liquid ejection head 1. The ink supplied to the liquid ejection head 1 is supplied from a case 2 to the print element substrates 5 and 6 through a support member 4. A sealing member 3 is provided between the flow path-forming member 2*b* of the case 2 and the support member 4 in order to secure sealability for the ink between the flow path-forming member 2*b* and the support member 4. The flow path-forming member 2*b* is an example of a flow path-forming part which forms a flow path for the liquid supplied from the liquid reservoir.

A signal and power used to drive the print element substrates 5 and 6 are sent to a printed circuit board 7 through the electrical connection part of the image recording device on which the liquid ejection head 1 is mounted. The signal and the power sent to the printed circuit board 7 are supplied to the print element substrates 5 and 6 through a wiring member 8. In response to the supplied signal and the power, print elements provided at the print element substrates 5 and 6 (elements which generate energy for ejecting the liquid such as a heater) are driven in desired timing, so that the ink is ejected from the ejecting port, and an image is formed.

Figure 2:
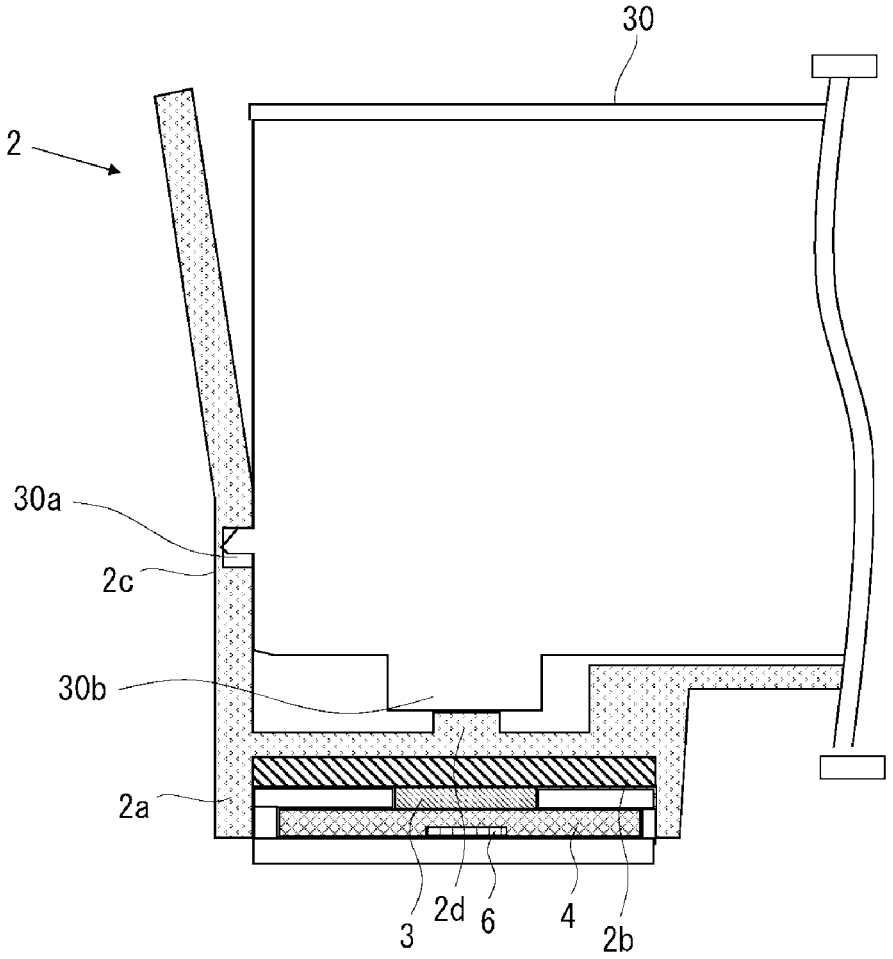
FIG. 2 is a cross-sectional view of the liquid ejection head and an ink tank according to the first embodiment.

FIG. 2 is a cross-sectional view taken along line X1-X1 shown in FIG. 1A and schematically illustrates the connection between the case 2 of the liquid ejection head 1 and the ink tank 30 according to the embodiment. As shown in FIG. 2, the ink tank 30 is mounted and secured to the case 2 as the protruding engagement part 30*a* of the ink tank 30 is engaged with the recessed engagement part 2*c* of the case 2. When the ink tank 30 is secured to the case 2, the ink introducing port 2*d* of the case 2 and an ink supply port 30*b* on the ink tank side are coupled. The ink tank 30 is provided with an ink absorber such as a sponge or a fiber assembly which is impregnated with and retains the ink, and the ink impregnated in the ink absorber flows from the ink supply port 30*b* through the ink introducing port 2*d* to the ink flow path formed in the case 2. The ink then flows through the case member 2*a* of the case 2, the flow path-forming member 2*b*, the sealing member 3, and the support member 4 to reach the print element substrates 5 and 6. Details of the configurations of these members and other components will be later described.

Figure 3A:
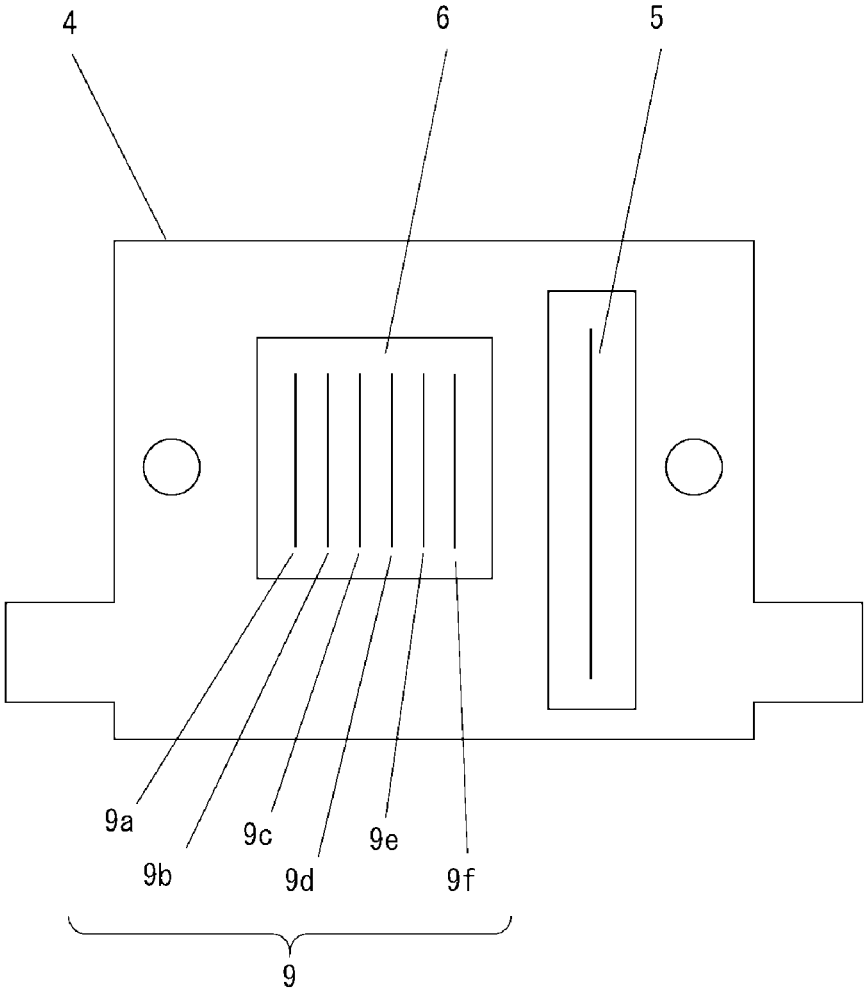
FIG. 3A is a schematic view of a support member according to the first embodiment.

FIG. 3A is a schematic view of the support member 4 and the print element substrates 5 and 6. According to the embodiment, the liquid ejection head 1 has the two print element substrates 5 and 6. The print element substrate 6 is provided with a plurality (six rows in the example shown in FIG. 2) of ejection element rows 9*a* to 9*f* having their print elements and ejecting outlet ports for ejecting ink arranged in rows in a direction orthogonal to the scanning direction 20 by the carriage. According to the embodiment, the direction orthogonal to the scanning direction 20 corresponds to the transport direction in which a recording medium to which the ejected ink sticks is fed and discharged. The print element in the ejection element row is an example of a liquid ejection element. The support member is an example of a liquid ejecting unit having an ejection element row.

Figure 3B:
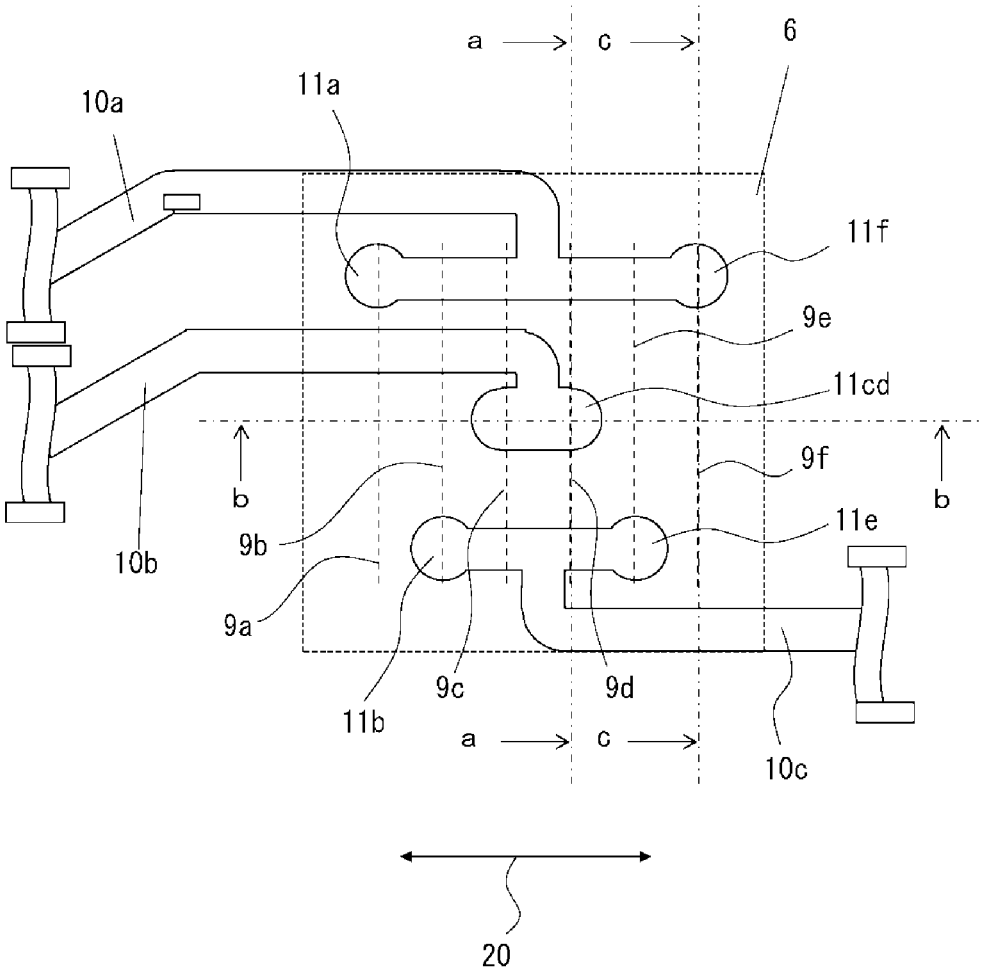
FIG. 3B is a schematic view of a print element substrate and ink flow paths according to the first embodiment.

FIG. 3B is a schematic view of the ejection element rows 9*a* to 9*f* at the print element substrate 6 and ink flow paths 10*a*, 10*b*, and 10*c* connected with the ejection element rows 9*a* to 9*f* The ink supplied from the ink tank flows through the ink flow paths 10*a*, 10*b*, and 10*c* formed in the case 2, is guided to immediately above the ejection element rows 9*a* to 9*f*, and is supplied to the print element substrate 6. According to the embodiment, the ink flow path 10*a* is provided as a common flow path for the two ejection element rows 9*a* and 9*f*. Similarly, the ink flow path 10*b* is provided as a common flow path for the two ejection element rows 9*c* and 9*d*, and the ink flow path 10*c* is provided as a common flow path for the two ejection element rows 9*b* and 9*e*. As a result, the ink is supplied to the two ejection element rows from one ink flow path. The configuration of the ink flow paths 10*a* to 10*c* is not limited to the above and may be, for example, a common ink flow path provided for one or two or more ejection element rows.

Figure 4:
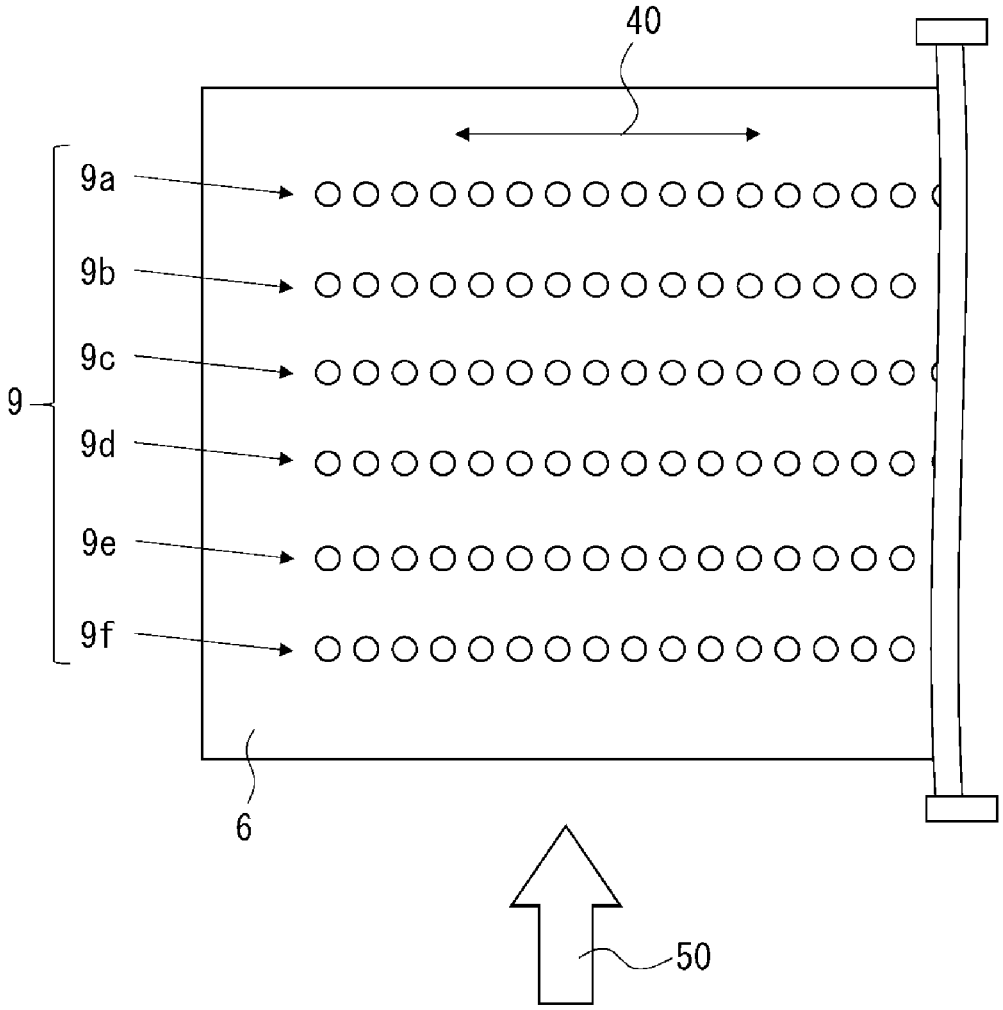
FIG. 4 is a schematic view for illustrating the relation between ejection element rows and a direction for transporting a recording medium according to the first embodiment.

FIG. 4 is a schematic view for illustrating the relation between the ejection element rows 9 at the print element substrate 6 and the direction for transporting the recording medium (indicated by the arrow 50) according to the embodiment. In each of the ejection element rows 9*a* to 9*f*, a plurality of print elements are provided to be aligned in one row at prescribed intervals. The ejection element rows 9*a* to 9*f* are spaced apart and in parallel to one another. The recording medium is transported in the direction (indicated by the arrow 50) which is substantially orthogonal to the direction (indicated by the arrow 40) in which the ejection element rows 9 extend. Here, the direction which is substantially orthogonal to the extending direction refers to a direction within 10 degrees from the direction which is orthogonal to the extending direction. The recording medium can be cut paper sheets or a continuous roll of paper.

Figure 5A:
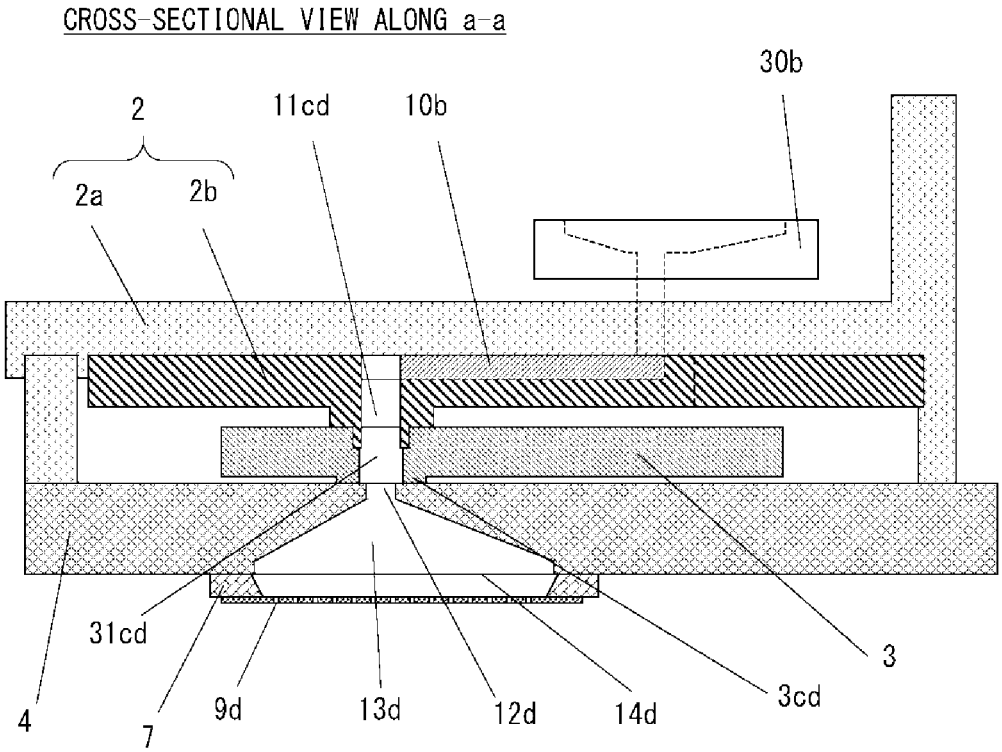
FIG. 5A is a schematic cross-sectional view of an ink supply channel according to the first embodiment.
Figure 5B:
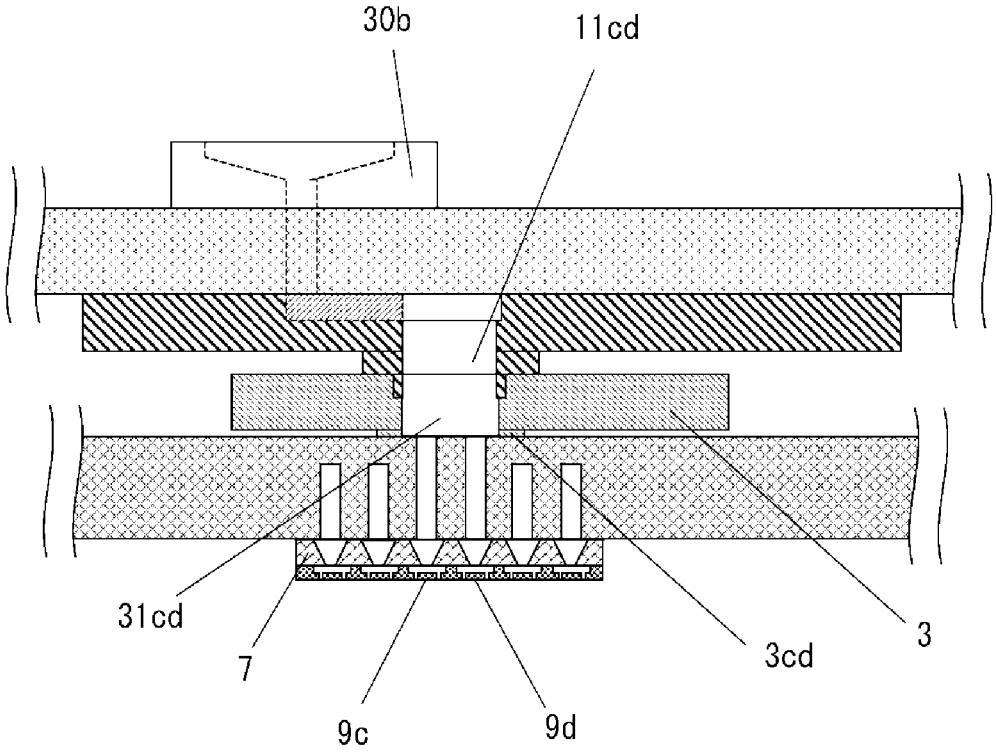
FIG. 5B is another schematic cross-sectional view of an ink supply channel according to the first embodiment.
Figure 5C:
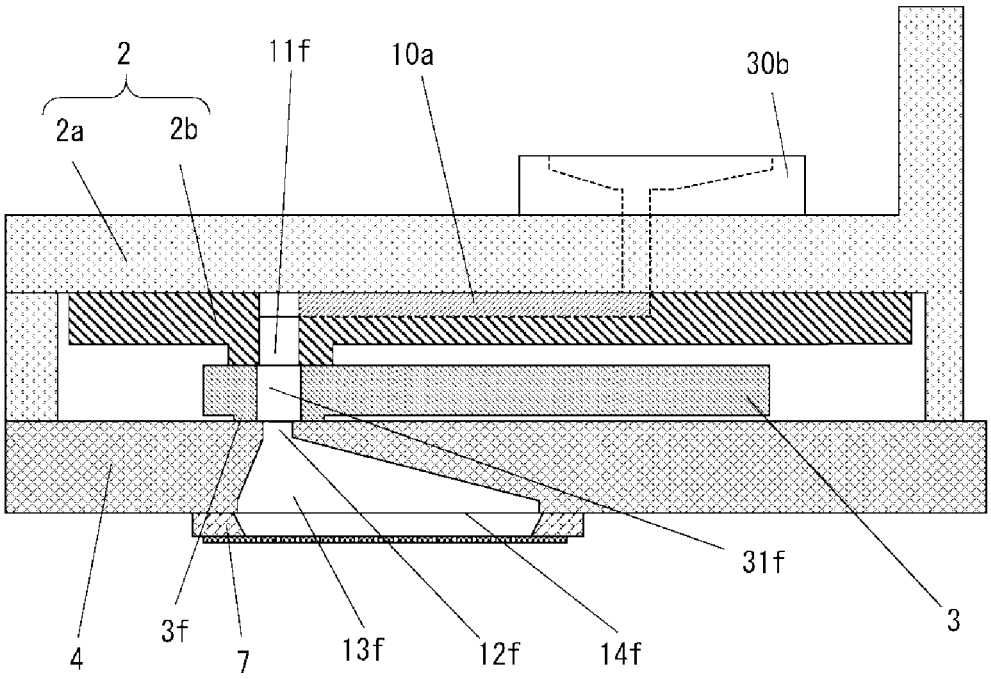
FIG. 5C is yet another schematic cross-sectional view of an ink supply channel according to the first embodiment.

Referring to FIGS. 5A to 5C, an ink supply channel from the case 2 to the print element substrate 6 will be described. FIG. 5A is a cross-sectional view taken along line a-a in FIG. 3B, FIG. 5B is a cross-sectional view taken along line b-b in FIG. 3B, and FIG. 5C is a cross-sectional view taken along line c-c in FIG. 3B.

The case 2 is made of the case member 2*a* and the flow path-forming member 2*b* which are joined together, and the ink flow paths 10*a* to 10*c* are formed as grooves provided in the flow path-forming member 2*b*. Ink outlet ports 11*a*, 11*b*, 11*cd*, 11*e*, and 11*f*, which open downstream immediately above the corresponding ejection element rows or toward the ejection element rows, are formed at one end of the ink flow paths 10*a* to 10*c*. The ink supplied from the ink tank reaches the ink outlet ports 11*a* to 11*f* corresponding to the respective ink flow paths 10*a* to 10*c* through the ink flow paths 10*a* to 10*c* in the case 2.

The sealing member 3 is provided between the case 2 and the support member 4. As shown in FIG. 5A, the ink outlet port 11*cd* for supplying ink to the ejection element rows 9*c* and 9*d* is provided as a common ink outlet port in the flow path-forming member 2*b*. The sealing member 3 has a plurality of sealing openings which are in communication with the ink outlet port and the ink inlet port. Specifically, the sealing member 3 has a sealing opening 31*cd* in communication with the ink outlet port 11*cd* and ink inlet port 12*c* and 12*d*. The sealing member 3 is provided with a sealing part 3*cd* which forms the sealing opening 31*cd*. In the example shown in FIGS. 3A and 3B and FIGS. 5A to 5C, the sealing member 3 has sealing parts 3*a*, 3*b*, 3*cd*, 3*e*, and 3*f* for the ink outlet ports 11*a*, 11*b*, 11*cd*, 11*e*, and 11*f*, respectively. The support member 4 has an ink inlet port 12*d* as an upper surface opening, a common liquid chamber 13*d*, and a lower surface opening 14*d* which are in communication with one another. The lower surface opening 14*d* is in communication with the ejection element row 9*d*. The common liquid chamber 13*d* is a common liquid chamber for supplying ink to a plurality of ejection elements of the ejection element row 9*d* at a time. An identical liquid chamber as the common liquid chamber 13*d* is provided for the other ejection element rows 9*a* to 9*c*, 9*e*, and 9*f*.

In this manner, the ink supplied from the ink tank flows through the ink flow path 10*b* to reach the ink outlet port 11*cd* and flows out of the ink outlet port 11*cd* to the sealing opening 31*cd*. The ink outlet port is an example of an outlet port from which the ink flows out. The ink flowing out of the ink outlet port 11*cd* flows through the sealing opening 31*cd* and into the ink inlet port 12*d*. The ink inlet port 12*d* is an example of the inlet port into which the ink flowing out of the outlet port flows. The ink flowing into the ink inlet port 12*d* flows sequentially through the common liquid chamber 13*d* and the lower surface opening 14*d* and is guided to the ejection element row 9*d*.

As shown in FIG. 5B, the ink outlet port 11*cd* is also in connection with the ink inlet port 12*c* through the sealing opening 31*cd* formed by the sealing part 3*cd*. Therefore, the ink flowing through the ink flow path 10*b*, after reaching the ink outlet port 11*cd*, flows sequentially through the sealing opening 31*cd*, the ink inlet port 12*c*, the common liquid chamber 13*c*, and the lower surface opening 14*c*, and is also guided to the ejection element row 9*c*. Similarly, as shown in FIG. 5C, the ink flowing through the ink flow path 10*a*, after reaching an ink outlet port 11*f*, flows sequentially through a sealing opening 31*f* formed by a sealing part 3*f*, an ink inlet port 12*f*, a common liquid chamber 13*f*, and the lower surface opening 14*f*, and is guided to the ejection element row 9*f*.

The part of the ink supply channel from the ink outlet ports 11*a* to 11*f* to the ink inlet ports 12*a* to 12*f* through the sealing openings 31*a* to 31*f* formed by the sealing parts 3*a* to 3*f*, which is also a feature of the present disclosure, will be described.

Figure 6A:
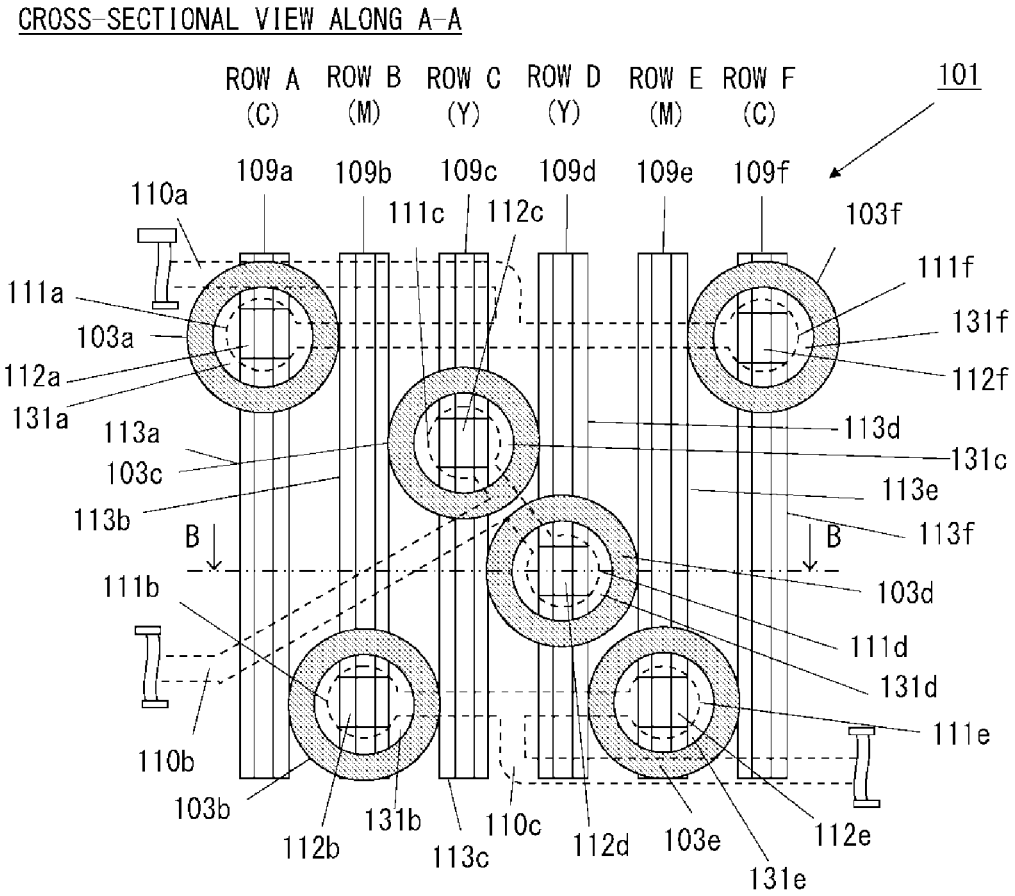
FIG. 6A is a schematic view of an exemplary arrangement of an ink supply channel and sealing members in a conventional case.
Figure 6B:
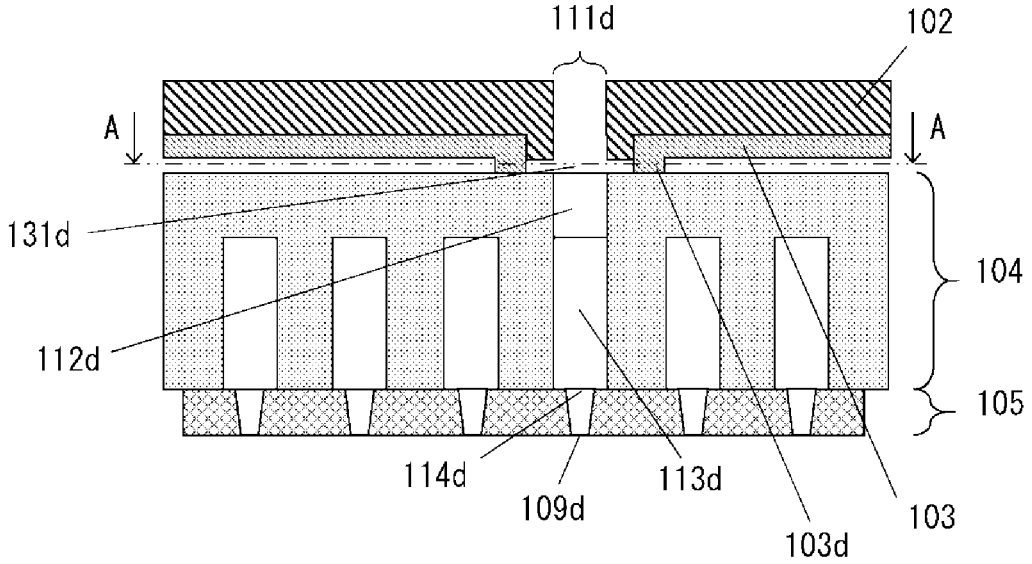
FIG. 6B is a cross-sectional view of the exemplary arrangement of the ink supply channel and the sealing members in the conventional case.

FIG. 6A shows an exemplary arrangement of the part from the ink outlet port to the ink inlet port via the sealing opening in the ink supply channel for a conventional liquid ejection head. FIG. 6A is a cross-sectional view taken along line A-A in FIG. 6B, and FIG. 6B is a cross-sectional view taken along line B-B in FIG. 6A. As shown in FIGS. 6A and 6B, the conventional liquid ejection head 101 has a case 102, a sealing member 103, a support member 104, and a print element substrate 105. The case 102 has ink flow paths 110*a*, 110*b*, and 110*c*. Ink outlet ports 111*a*, 111*b*, 111*c*, 111*d*, 111*e*, and 111*f* are provided at one end of the ink flow paths 110*a* to 110*c*. Sealing parts 103*a*, 103*b*, 103*c*, 103*d*, 103*e*, and 103*f* are provided in the sealing member 103. The ink outlet ports 111*a* to 111*f* are in communication with the ink inlet ports 112*a* to 112*f*, respectively, by sealing openings 131*a* to 131*f* formed by the sealing parts 103*a* to 103*f*. The ink inlet ports 112*a* to 112*f* are in communication with the common liquid chambers 113*a* to 113*f* and the lower surface openings 114*a* to 114*f*, respectively.

The print element substrate 105 is provided with a plurality of ejection element rows 109. The ejection element rows 109 include six ejection element rows 109*a* to 109*f*. As shown in FIG. 6A, the ejection element rows 109*a*, 109*b*, 109*c*, 109*d*, 109*e*, and 109*f* correspond to the ejection element rows in rows A, B, C, D, E, and F, respectively. The ink flows through the ink flow paths 110*a* to 110*c* to reach the ink outlet ports 111*a* to 111*f*. The ink is then guided to flow sequentially through the sealing parts 103*a* to 103*f*, the sealing openings 131*a* to 131*f*, the ink inlet ports 112*a* to 112*f*, the common liquid chambers 113*a* to 113*f*, and the lower surface openings 114*a* to 114*f* to reach the ejection element rows 109*a* to 109*f*.

In this way, in the conventional liquid ejection head 101, an ink outlet port, a sealing opening, a sealing part, an ink inlet port, a common liquid chamber, and a lower surface opening corresponding to each of the ejection element rows 109*a* to 109*f* are provided independently. As shown in FIG. 6A, the ink is supplied to the ejection element rows 109*a* and 109*f* through the common ink flow path 110*a*. Similarly, ink is supplied to the ejection element rows 109*c* and 109*d* through the common ink flow path 110*b*, and to the ejection element rows 109*b* and 109*e* through the common ink flow path 110*c*. More specifically, in the arrangement shown in FIG. 6A, the ink of the same color (C) is ejected by the ejection element row 109*a* in the row A and the ejection element row 109*f* in the row F. Similarly, ink of the same color (M) is ejected by the ejection element row 109*b* in the row B and the ejection element row 109*e* in the row E, and ink (Y) of the same color is ejected by the ejection element row 109*c* in the row C and the ejection element row 109*d* in the row D.

Therefore, in the liquid ejection head 101, when ink of the same color is ejected by a plurality of ejection element rows, ink supply channels are provided independently for the ejection element rows 109*a* to 109*f*. For the ejection element rows which are adjacent to each other among the ejection element rows 109*a* to 109*f*, the sealing parts 103*a* to 103*f* can be arranged without interfering with each other when a sufficient spacing is secured between the rows. Meanwhile, since the print element substrate 105 is a relatively expensive component among the components of the liquid ejection head 101, the print element substrate 105 must be downsized in some cases in order to provide the liquid ejection head at the lowest possible cost. In such a case, the spacing between adjacent ejection element rows among the ejection element rows 109*a* to 109*f* may be reduced.

Figure 7A:
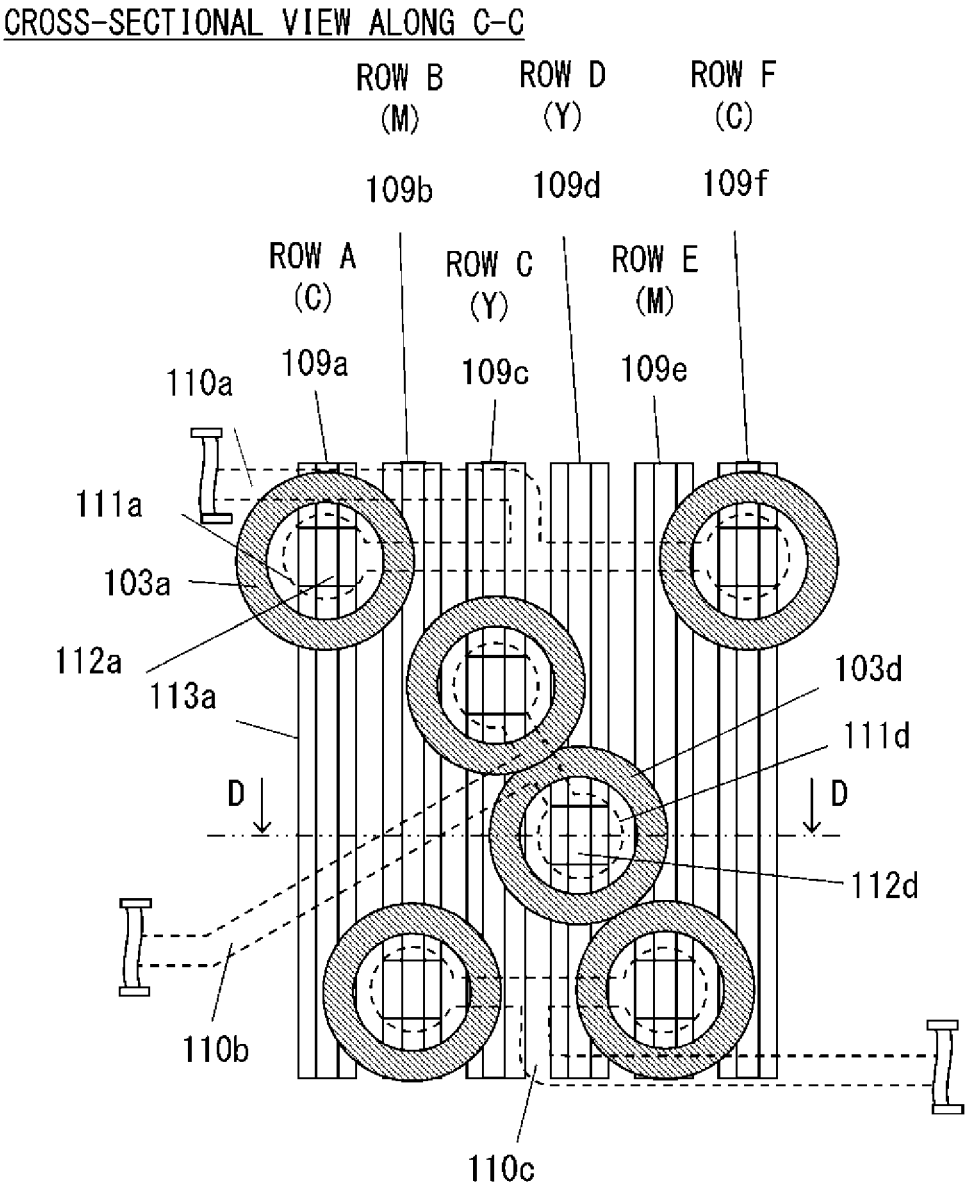
FIG. 7A is a schematic view of another exemplary arrangement of an ink supply channel and sealing members in a conventional case.
Figure 7B:
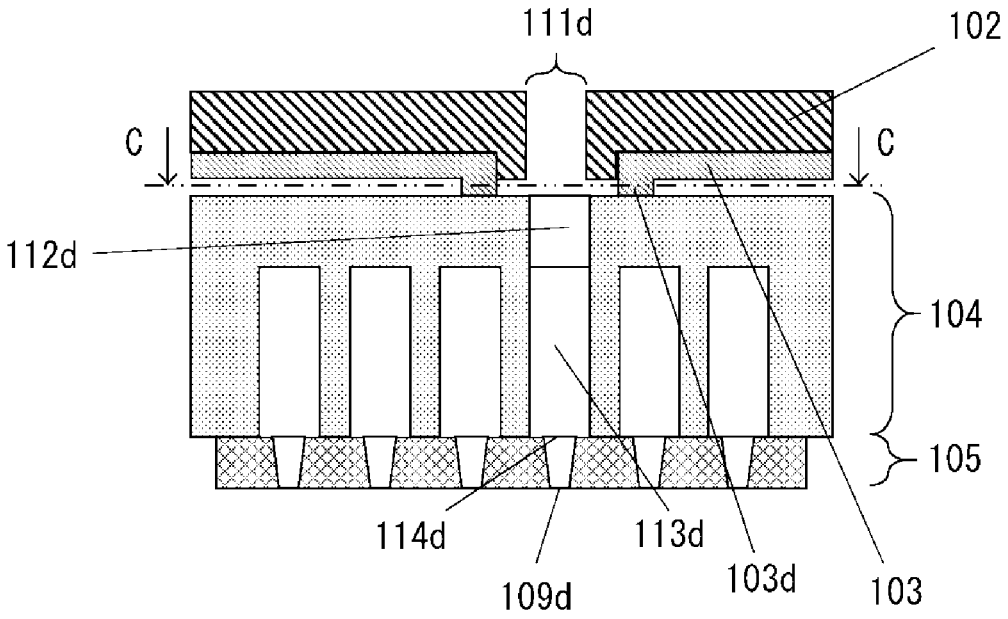
FIG. 7B is a cross-sectional view of the exemplary arrangement of the ink supply channel and the sealing members in the conventional case.

Therefore, as shown in FIGS. 7A and 7B, the spacing between the adjacent ejection element rows is smaller than that shown in FIGS. 6A and 6B. In FIGS. 7A and 7B, the ink supply channels from the ink outlet ports 111*a* to 111*f* to the common liquid chambers 113*a* to 113*f* are independently provided for the ejection element rows 109*a* to 109*f*. FIG. 7A is a cross-sectional view taken along line C-C in FIG. 7B, and FIG. 7B is a cross-sectional view taken along line D-D in FIG. 7A.

In this case, it is highly likely that the sealing members (in FIG. 7A, the sealing parts 103*c* and 103*d* and the sealing parts 103*d* and 103*e*) provided in the adjacent ejection element rows among the sealing parts 103*a* to 103*f* interfere with each another. Meanwhile, when the thickness of the sealing parts 103*a* to 103*f* is reduced in order to avoid such interference among the sealing parts 103*a* to 103*f*, the sealability (sealing performance) by the sealing parts 103*a* to 103*f* may be reduced, and the possibility of leakage of supplied ink or air may increase. In order to avoid such interference among the sealing parts 103*a* to 103*f*, the degree of flexibility in arranging the ink outlet ports 111*a* to 111*f* should be lowered.

Figure 8A:
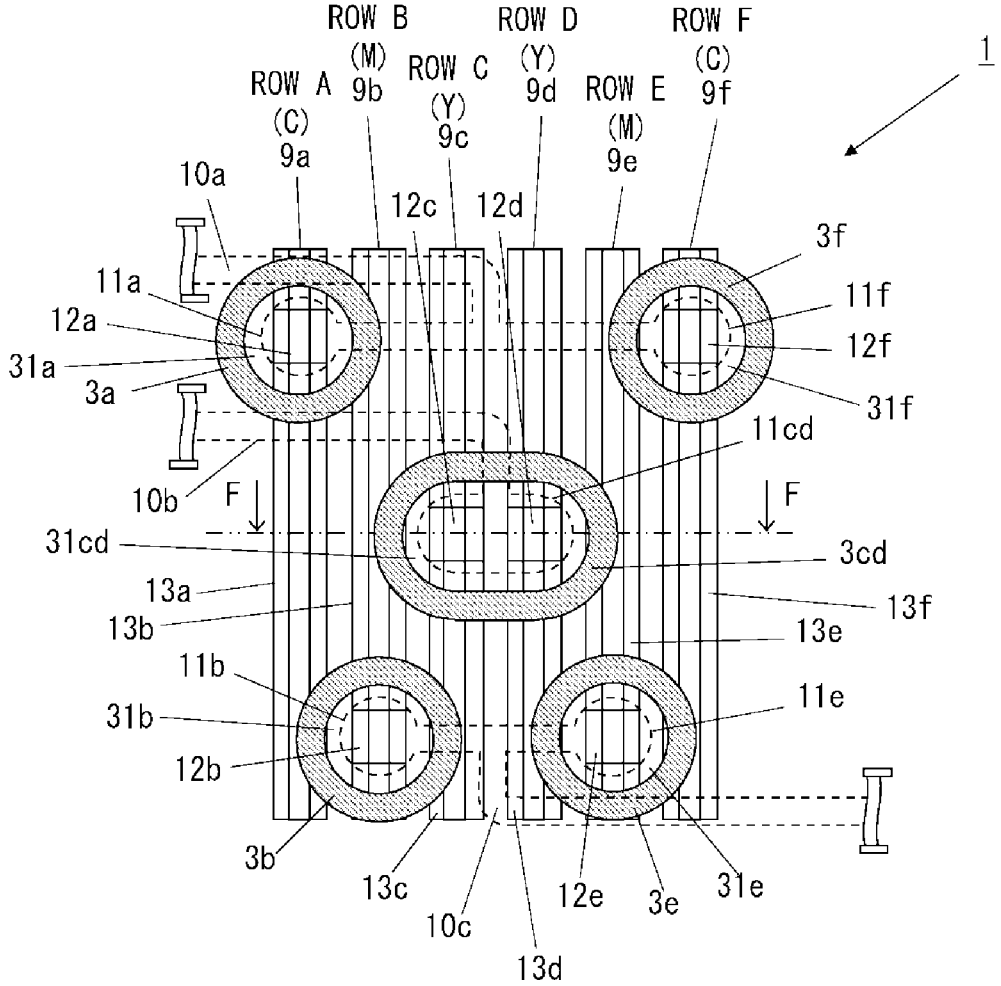
FIG. 8A is a schematic view of an exemplary arrangement of an ink supply channel and sealing members according to the first embodiment.
Figure 8B:
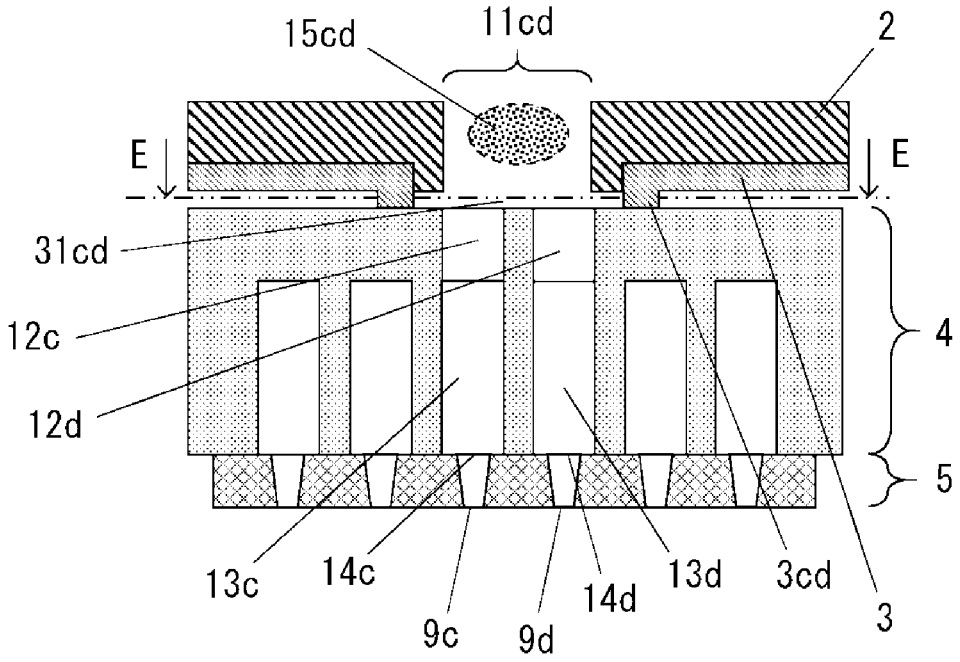
FIG. 8B is a cross-sectional view of an exemplary arrangement of the ink supply channel and the sealing members according to the first embodiment.

Therefore, in the liquid ejection head 1 according to the embodiment, the sealing parts 3*a*, 3*b*, 3*cd*, 3*e*, and 3*f* are formed as illustrated in FIGS. 8A and 8B. FIG. 8A is a cross-sectional view taken along line E-E in FIG. 8B, and FIG. 8B is a cross-sectional view taken along line F-F in FIG. 8A. In the liquid ejection head 1, ink of the same color is supplied to a plurality of ejection element rows through a common ink flow path. In other words, in the example illustrated in FIG. 8A, ink of the same color (C) is ejected by the ejection element row 9*a* in the row A and the ejection element row 9*f* in the row F. Similarly, ink of the same color (M) is ejected by the ejection element row 9*b* in the row B and the ejection element row 9*e* in the row E, and ink of the same color (Y) is ejected by the ejection element row 9*c* in the row C and the ejection element row 9*d* in the row D.

In the example shown in FIGS. 8A and 8B, the ink outlet port 11*cd*, the sealing opening 31*cd*, and the ink inlet ports 12*c* and 12*d* are in communication with one another. The ink outlet ports 11*a*, 11*b*, 11*e*, and 11*f*, the sealing openings 31*a*, 31*b*, 31*e*, and 31*f*, and the ink inlet ports 12*a*, 12*b*, 12*e*, and 12*f* are in communication with one another. Here, the ink inlet ports 12*c* and 12*d* are examples of first and second inlet ports.

Therefore, the ink outlet port 11*cd* supplied with the ink of the same color (Y), the sealing opening 31*cd*, and the sealing part 3*cd* are shared between the two ejection element rows 9*c* and 9*d*. The sealing opening 31*cd* which communicates the ink outlet port 11*cd* and the two ink inlet ports 12*c* and 12*d* is surrounded by the single sealing part 3*cd*. In this way, at least two ink inlet ports are surrounded by one opening in the sealing part. Therefore, if the spacing between the ejection element rows 9*c* and 9*d* is reduced, it is unlikely that the sealability by the sealing parts is lowered by interference among the sealing parts, as is the case with the sealing parts 103*c* and 103*d* described above. Also, unlike the case shown in FIG. 7A, interference between the sealing part 3*cd* provided at the ejection element rows 9*c* and 9*d* for ink (Y) and the sealing part 3*e* provided in the ejection element row 9*e* for ink of a different color (M) can also be avoided.

In this way, according to the embodiment, interference between the sealing parts provided at the plurality of ink outlet ports supplied with ink of the same color can be avoided, while interference with the sealing part provided at the ink outlet port supplied with ink of a different color can also be avoided. As a result, it can be expected that the degree of flexibility in arranging the ink outlet ports 11*a* to 11*f* provided in the ejection element rows 9*a* to 9*f* is increased.

Furthermore, since the sealing part 3*cd* is provided across the plurality of ink inlet ports 12*c* and 12*d*, the opening of the ink outlet port 11*cd* can be set larger than the openings of the ink outlet ports 111*c* and 111*d* in the conventional case, as can be seen from the comparison between FIGS. 7B and 8B. The ink outlet port 11*cd* is formed to be wide enough to include respective regions opposed to the two ink inlet ports 12*c* and 12*d*. The ink outlet port 11*cd* is an example of a first outlet port that includes respective regions opposed to at least two inlet ports. This makes it easier for air bubbles 15*cd* entering or generated in the ink flow path 10*b* to stay in the ink outlet port 11*cd* and suppresses ejection failures due to the movement of the air bubbles 15*cd* to the ejection element rows 9*c* and 9*d* on the print element substrate 6.

Second Embodiment

Figure 9A:
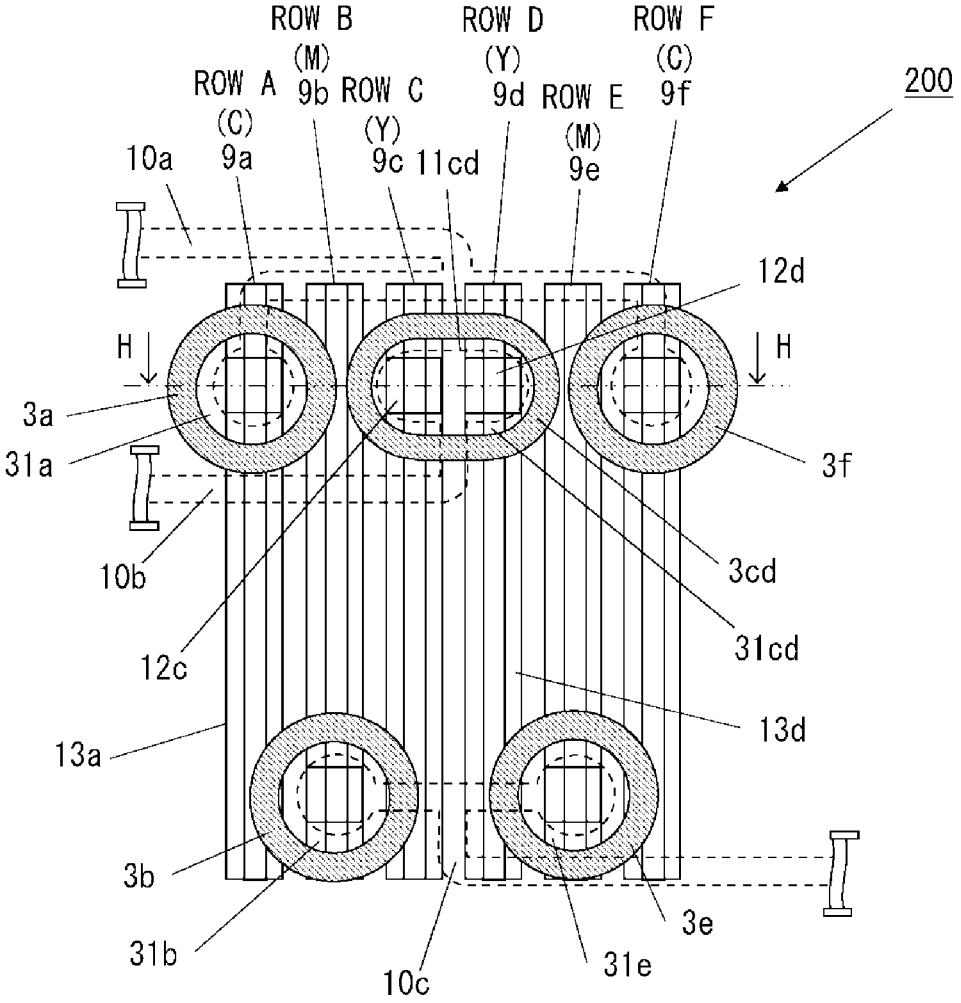
FIG. 9A is a schematic view of an exemplary arrangement of an ink supply channel and sealing members according to a second embodiment of the present disclosure.
Figure 9B:
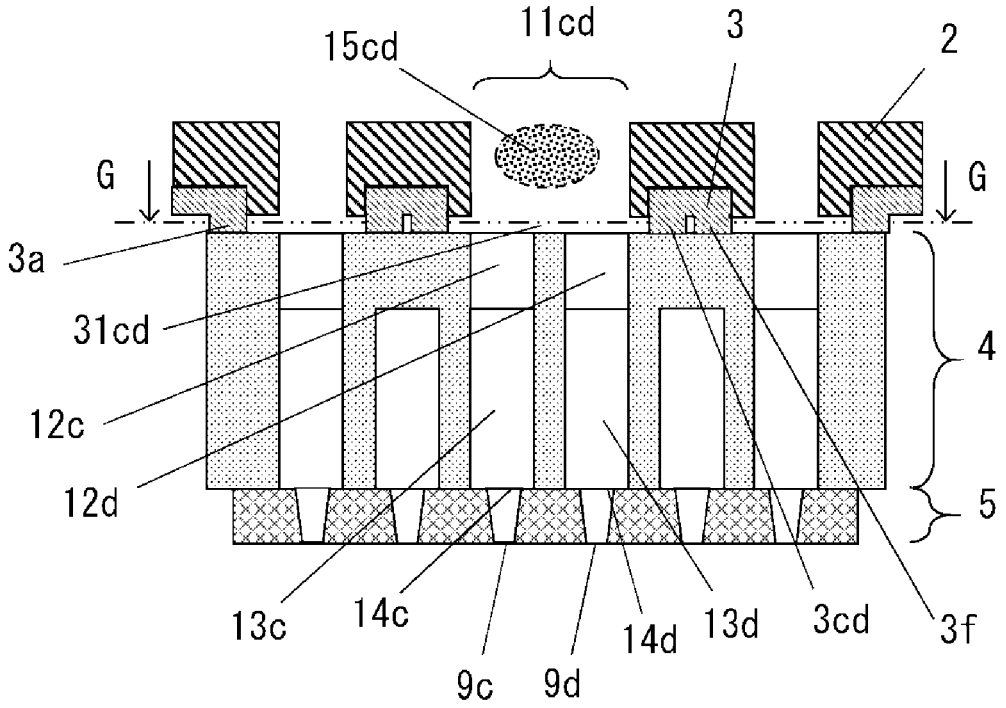
FIG. 9B is a cross-sectional view of an exemplary arrangement of the ink supply channel and the sealing members according to the second embodiment.

A liquid ejection head according to a second embodiment of the disclosure will be described. In the following description, the same components as those in the first embodiment are designated by the same reference characters, and their detailed description will not be provided. In the liquid ejection head 1 described above, it has been found that as the ink inlet ports 12*a* to 12*f* in the support member 4 are provided in a position closer to ends of the ejection element rows 9*a* to 9*f*, air bubbles generated in the ink flow paths 10*a* to 10*c* are more easily discharged. Therefore, as shown in FIGS. 9A and 9B, in a liquid ejection head 200 according to the embodiment, the sealing parts 3*a*, 3*b*, 3*cd*, 3*e*, and 3*f* may be provided closer to one end of the ejection element rows 9*a* to 9*d*. FIG. 9A is a cross-sectional view taken along line G-G in FIG. 9B, and FIG. 9B is a cross-sectional view taken along line H-H in FIG. 9A.

In this way, it can be considered that as the ink outlet port 11*cd* is provided closer to one end of the ejection element rows 9*c* and 9*d*, the air bubbles 15*cd* generated in the ink flow path 10*b* can be discharged more easily than when the ink outlet port 11*cd* is provided in the middle between the ejection element rows 9*c* and 9*d*. In the example shown in FIG. 9A, let us focus on the ejection element rows 9*b* and 9*e* in parallel to the ejection element rows 9*c* and 9*d* corresponding to the two ink inlet ports 12*c* and 12*d*. Here, the ejection element rows 9*b* and 9*e* adjacent to the ejection element rows 9*c* and 9*d* are examples of adjacent ejection element rows. The ink inlet ports 12*b* and 12*e* corresponding to the ejection element rows 9*c* and 9*d* are provided closer to the other end of the ejection element row 9*c* and 9*d* with respect to the previously mentioned one end of the ejection element row 9*c* and 9*d* provided with the ink inlet ports 12*c* and 12*d*. It can be considered that as each of the ink inlet ports is provided closer to one end of the corresponding ejection element row, air bubbles generated in each of the ink flow paths 10*a* and 10*c* can be more easily discharged. Also, it is unlikely that the sealing part 3*d* which forms the sealing opening 31*cd* interferes with the sealing part 3*b* which forms the sealing opening 31*b* and the sealing part 3*e* which forms the sealing opening 31*e*.

In the conventional liquid ejection head 101, the ink supply channels from the ink outlet ports 111*a* to 111*f* to the common liquid chambers 113*a* to 113*f* are provided independently. In this case, it is difficult to provide the ink inlet ports 112*a* to 112*f* in the ejection element rows 109*a* to 109*f* at ends of the ejection element rows 109*a* to 109*f* in consideration of the space occupied by the sealing parts 103*a* to 103*f*. Meanwhile, according to the embodiment, as in the example shown in FIG. 9A, the ink outlet port 11*cd* and the sealing part 3*cd* provided in the two ejection element rows 9*c* and 9*d* supplied with the ink of the same color (Y) are shared. The single sealing part 3*cd* surrounds the sealing opening 31*cd* which communicates the ink outlet port 11*cd* and the ink inlet ports 12*c* and 12*d*. In this manner, the ink supply channels provided in the two ejection element rows 9*c* and 9*d* are sealed between the case 2 and the support member 4. As a result, the ink inlet ports 12*a* to 12*f* in the ejection element rows 9*a* to 9*f* can be positioned at an end of each ejection element row, and it can be expected that the discharge performance for air bubbles generated in the ink flow paths 10*a* to 10*c* can be improved as described above.

In the above description, the ink outlet port 11*cd* and the sealing part 3*cd* are shared by the two ejection element rows 9*c* and 9*d* adjacent to each other. Meanwhile, according to the embodiment, an ink outlet port and a sealing part may be shared among at least two ejection element rows, and a sealing opening may be formed from one sealing part in communication with two or more ink inlet ports.

According to the present embodiment, even when the spacing between the rows in the ejection element rows 9*a* to 9*f* is reduced in order to downsize the print element substrate 6, the sealability for the ink flow path can be maintained and the operation reliability of the liquid ejection head can be maintained. Therefore, according to the embodiment, a smaller and less expensive liquid ejection head can be provided while achieving the same operation stability as the conventional case. Furthermore, according to the embodiment, a high degree of flexibility in arranging the ink inlets can be provided, so that improved discharge performance for air bubbles generated in the ink flow paths can also be provided.

Although the embodiments according to the present disclosure have been described, the description of the embodiments are illustrated for the purpose of describing the present disclosure, and features of the present disclosure can be modified or combined as appropriate and carried out in the range without departing from the purpose of the invention. An example of modification of the above embodiment is explained below. Note that in the following description, the components identical to those of the embodiments are designated by the same reference characters and their detailed description will not be repeated.

Figure 10A:
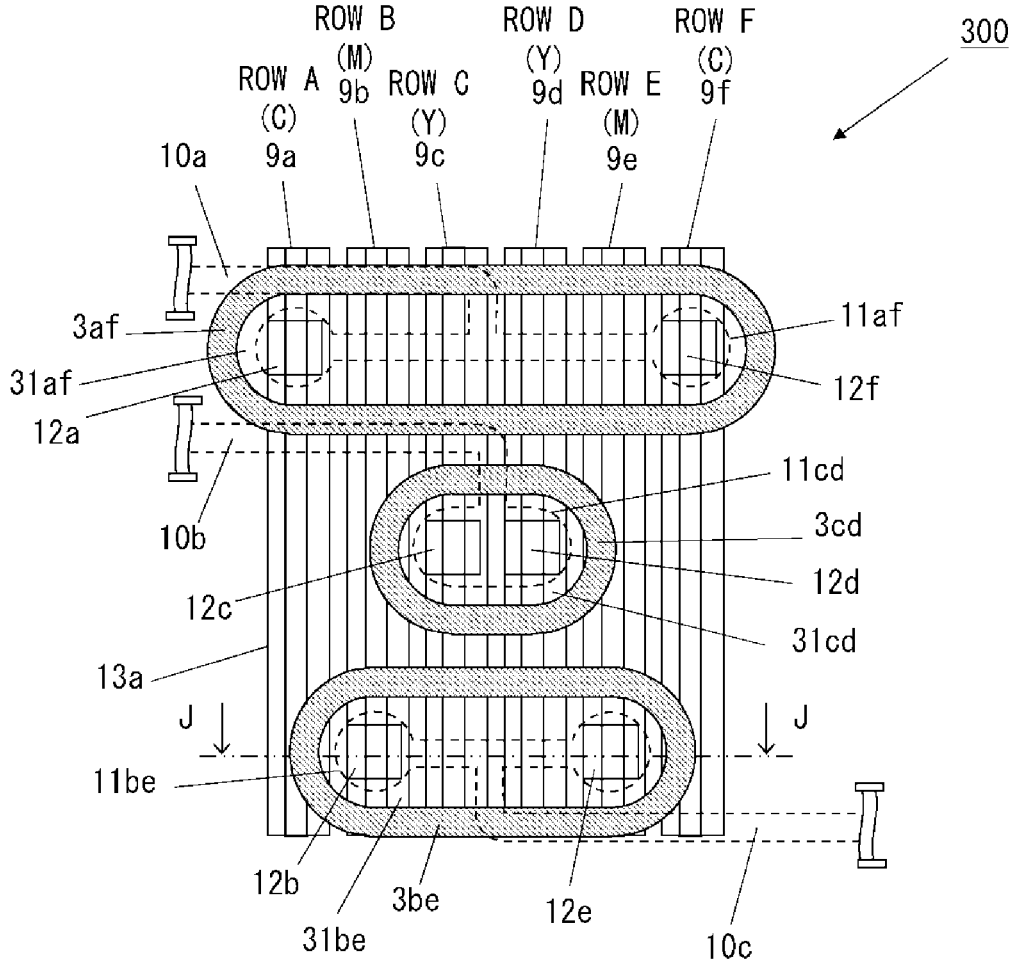
FIG. 10A is a schematic view of an exemplary arrangement of an ink supply channel and sealing members according to a modification.
Figure 10B:
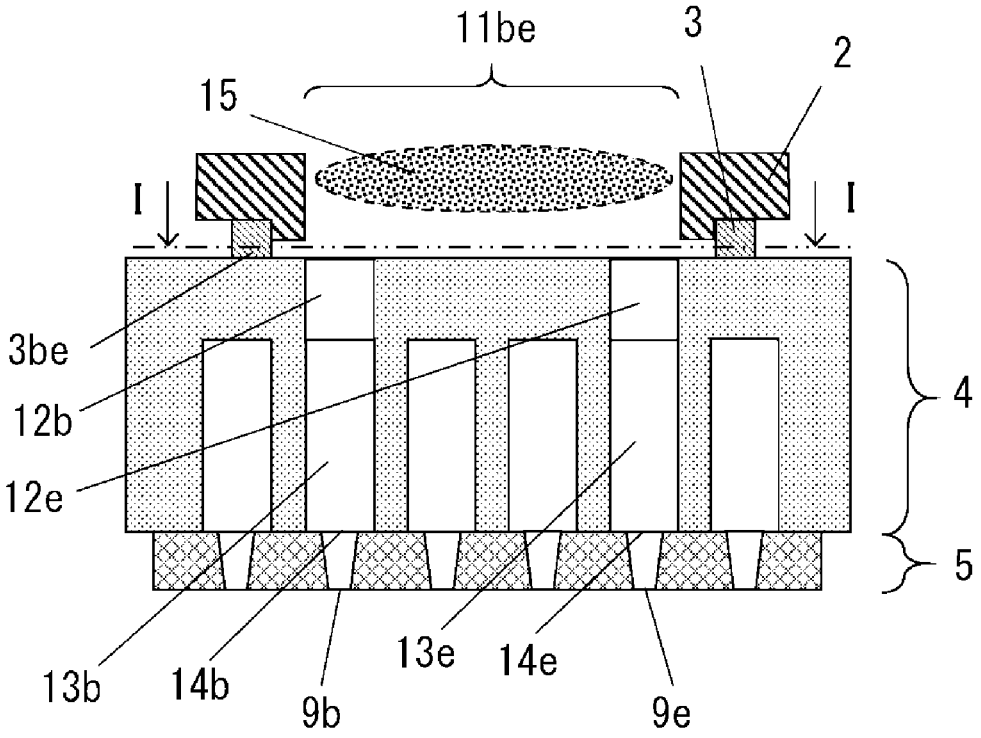
FIG. 10B is a cross-sectional view of the exemplary arrangement of the ink supply channel and the sealing members according to the modification.

FIGS. 10A and 10B are cross-sectional views of the ink supply channels of a liquid ejection head according to a modification. FIG. 10A is a cross-sectional view taken along line I-I in FIG. 10B, and FIG. 10B is a cross-sectional view taken along line J-J in FIG. 10A.

According to the embodiments, the ink outlet port 11*cd* and the sealing part 3*cd* are shared between the ejection element rows 9*c* and 9*d* adjacent to each other among the ejection element rows 9*a* to 9*f* supplied with ink of the same color. In a liquid ejection head 300 according to the modification, an ink outlet port and a sealing part are shared between non-adjacent ejection element rows supplied with ink of the same color among the ejection element rows 9*a* to 9*f*.

As shown in FIG. 10A, according to the modification, the ink outlet port 11*cd* and the sealing part 3*cd* are shared between the pair of ejection element rows 9*c* and 9*d* similarly to the above embodiments. In addition, an ink outlet port 11*af* and a sealing part 3*af* are also shared between the pair of ejection element rows 9*a* and 9*f* in the rows A and F across the other ejection element rows between these two ejection element rows. Also, an ink outlet port 11*be* and a sealing part 3*be* are shared between the pair of ejection element rows 9*b* and 9*e* in the rows B and E across the other ejection element rows between these two ejection element rows.

Then, the sealing openings 31*a* and 31*f* which communicate the ink outlet ports 11*a* and 11*f* provided in the two ejection element rows 9*a* and 9*f* supplied with ink of the same color (C) and the ink inlet ports 12*a* and 12*f* are surrounded by the single sealing part 3*af*. The sealing openings 31*b* and 31*e* which communicate the ink outlet ports 11*b* and 11*e* provided in the two ejection element rows 9*b* and 9*e* supplied with ink of the same color (M) and the ink inlet ports 12*b* and 12*e* are surrounded by the single sealing part 3*be*. Here, the ink inlet ports 12*a* and 12*f* are examples of third and fourth inlet ports.

In this way, according to the modification, the ejection element rows 9*b* to 9*e* provided corresponding to different liquid chambers 13*b* to 13*e* are provided between the ejection element rows 9*a* and 9*f* provided corresponding to the common liquid chambers 13*a* and 13*f* supplied with ink by the ink inlet ports 12*a* and 12*f*. Similarly, the ejection element rows 9*c* and 9*d* are provided between the ejection element rows 9*b* and 9*e*. Then, the spaces of the ink outlet ports 11*a* to 11*f* are set according to the sizes of the spaces surrounded by the sealing parts 3*af*, 3*cd*, and 3*be*.

Therefore, the spaces of the ink outlet ports 11*a* to 11*f* are larger than the spaces of the ink outlet ports 111*a* to 111*f* surrounded by the conventional sealing parts 103*a* to 103*f*. As a result, it is expected that air bubbles can more easily stay in the ink flow paths 10*a* to 10*c*, and ejection failures due to the air bubbles in the ejection element rows 9*a* to 9*f* can be further reduced.

Figure 11:
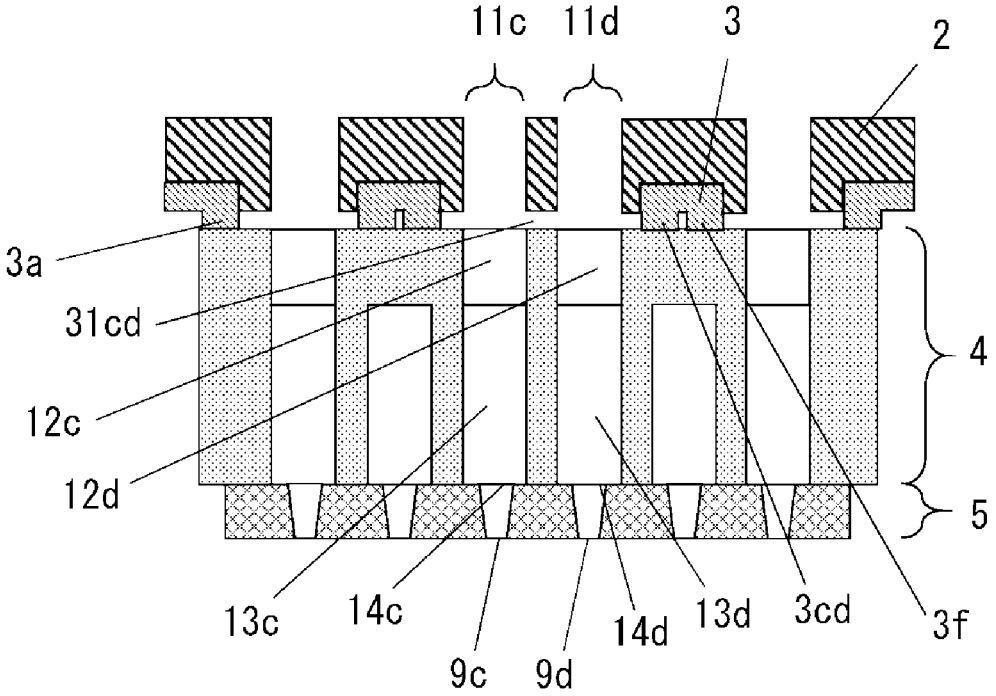
FIG. 11 is a cross-sectional view of another exemplary arrangement of an ink supply channel and sealing members according to the modification.

In the above description, one common ink outlet port is provided for a plurality of ink inlet ports for example as the single ink outlet port 11*cd* is provided for the two ink inlet ports 12*c* and 12*d*. Note however that one ink outlet port may be provided for one ink inlet port, and a plurality of ink inlet ports and a plurality of ink outlet ports may be provided in communication with one another through one sealing opening surrounded by one sealing part. For example, the arrangement may be as shown in FIG. 11. FIG. 11 is a cross-sectional view of the arrangement corresponding to FIG. 9A. As shown in FIG. 11, two ink outlet ports 11*c* and

11*d* are provided for two ink inlet ports 12*c* and 12*d*. The ink outlet ports 11*c* and 11*d* and the ink inlet ports 12*c* and 12*d* are in communication with one another through one sealing opening 31*cd* formed by one sealing part 3*cd*. Also in this arrangement, the sealing part is shared among the plurality of ejection element rows, so that it can be expected that the sealing part and thus the ink outlet ports may be arranged with a higher degree of flexibility than the conventional sealing part.

According to the present disclosure, even when the print element substrates are downsized and the distance between the ejection element rows is reduced, a sufficient sealing opening can be secured for a sealing part and desired sealability can be provided. Then, a liquid ejection head with high sealability for liquid flow paths can be provided while the ejection element substrates are downsized and produced less expensively.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-220471, filed Dec. 5, 2019, which is hereby incorporated by reference herein in its entirety.

What is claimed is:

1. A liquid ejection head, comprising:

a printed circuit board having a plurality of ejection element rows in which a plurality of ejection elements for ejecting liquid are arranged in rows;

a support member that supports the printed circuit board and includes a plurality of inlet ports for supplying the liquid to the plurality of ejection element rows;

a flow path-forming part having a plurality of outlet ports for supplying the liquid supplied from a liquid reservoir to the plurality of inlet ports; and a sealing member provided between the support member and the flow path-forming part and having a plurality of sealing openings which are configured to seal the plurality of inlet ports and the plurality of outlet ports and configured to be in communication with the plurality of inlet ports and the plurality of outlet ports, wherein the plurality of sealing openings are formed of a rubber material, and at least one of the plurality of sealing openings is in communication with at least two of the plurality of inlet ports.

2. The liquid ejection head according to claim 1, wherein the at least two inlet ports include first and second inlet ports, and the ejection element row corresponding to the first inlet port and the ejection element row corresponding to the second inlet port are provided adjacent to each other.

3. The liquid ejection head according to claim 2, wherein a first outlet port among the plurality of outlet ports is in communication with the first and second inlet ports, and the first outlet port includes respective regions opposed to the first and second inlet ports.

4. The liquid ejection head according to claim 1, wherein the at least two inlet ports include first and second inlet ports, and an ejection element row for ejecting liquid coming into an inlet port different from the first and second inlet ports is provided between the ejection element row corresponding to the first inlet port and the ejection element row corresponding to the second inlet port.

5. The liquid ejection head according to claim 4, wherein a first outlet port among the plurality of outlet ports is in communication with the first and second inlet ports, and the first outlet port includes respective regions opposed to the first and second inlet ports.

6. The liquid ejection head according to claim 1, wherein the at least two inlet ports are positioned closer to one end of the ejection element row corresponding to each of the at least two inlet ports.

7. The liquid ejection head according to claim 6, wherein an inlet port corresponding to an adjacent ejection element row in parallel with the ejection element row corresponding to each of the at least two inlet ports is positioned closer to the other end with respect to one end of the adjacent ejection element row.

8. The liquid ejection head according to claim 7, wherein the plurality of sealing openings include one sealing opening having a plurality of inlet ports positioned closer to the other end of the adjacent ejection element row.

9. The liquid ejection head according to claim 1, wherein each of the ejection element rows extends in a direction substantially orthogonal to a transport direction for a recording medium to which the ejected liquid sticks.

10. The liquid ejection head according to claim 1, wherein the liquid ejecting unit has a common liquid chamber for supplying the liquid to the plurality of ejection elements at a time for each of the ejection element rows corresponding to the inlet ports.

11. The liquid ejection head according to claim 1, further comprising a case having the flow path-forming part and the liquid reservoir.

12. The liquid ejection head according to claim 1, wherein a first outlet port among the plurality of outlet ports is in communication with the at least two inlet ports, and the first outlet port includes respective regions opposed to the at least two inlet ports.

* * * * *